US009517875B2

(12) United States Patent
Zeiter et al.

(10) Patent No.: US 9,517,875 B2
(45) Date of Patent: Dec. 13, 2016

(54) PACKAGING, USE OF A PACKAGING AND METHOD FOR ASSEMBLING SEVERAL PACKAGING

(75) Inventors: Frank Zeiter, Darmstadt (DE); Peter Lamboy, Weiterstadt (DE); Heiko Tullney, Hamburg (DE); Guenter Wissmann, Schenefeld (DE)

(73) Assignee: KAO GERMANY GMBH, Darmstadt (DE)

( * ) Notice: Subject to any disclaimer, the term of this patent is extended or adjusted under 35 U.S.C. 154(b) by 1144 days.

(21) Appl. No.: 12/993,017

(22) PCT Filed: Jun. 4, 2009

(86) PCT No.: PCT/EP2009/056850

§ 371 (c)(1),
(2), (4) Date: Nov. 16, 2010

(87) PCT Pub. No.: WO2009/147194

PCT Pub. Date: Dec. 10, 2009

(65) Prior Publication Data

US 2011/0127260 A1 Jun. 2, 2011

(30) Foreign Application Priority Data

Jun. 5, 2008 (EP) ..... 08157657

(51) Int. Cl.
*A47G 19/00* (2006.01)
*B65D 81/32* (2006.01)
(Continued)

(52) U.S. Cl.
CPC ..... *B65D 81/3288* (2013.01); *B65D 77/245* (2013.01); *A47G 23/0216* (2013.01);
(Continued)

(58) Field of Classification Search
CPC A47G 23/0216; A47G 23/0258; B60N 3/013; B65D 7/24; B65D 2519/00273; B65D 2519/00333
(Continued)

(56) References Cited

U.S. PATENT DOCUMENTS 3,446,386 A * 5/1969 Wellington ..... 220/4.27
4,893,719 A 1/1990 Lombardi
(Continued)

FOREIGN PATENT DOCUMENTS

EP 1033320 A2 * 9/2000
NL 1 029 872 C2 3/2007
(Continued)

OTHER PUBLICATIONS

International Search Report dated Jan. 22, 2010.

*Primary Examiner* — Fenn Mathew
*Assistant Examiner* — Kevin Castillo
(74) *Attorney, Agent, or Firm* — Norris McLaughlin & Marcus PA

(57) ABSTRACT

A packaging (10) for receiving a filling material comprises a filling material compartment (12) for receiving the filling material is provided. The packaging (10) further comprises an additional compartment (14) for forming an additional volume separated from the filling material compartment (12). The additional compartment (14) is moveable along a fastening direction (44) from an unfastened state to a state fastened to the filling material compartment (12). In the fastened state, the additional compartment (14) is fastened to the filling material compartment (12) via a first fastening means (30). Additionally, the additional compartment (14) is fastened to the filling material compartment (12) via a second fastening means (42) spaced to the first fastening means (30) both in fastening direction (44) and crosswise to
(Continued)

Figure 1:
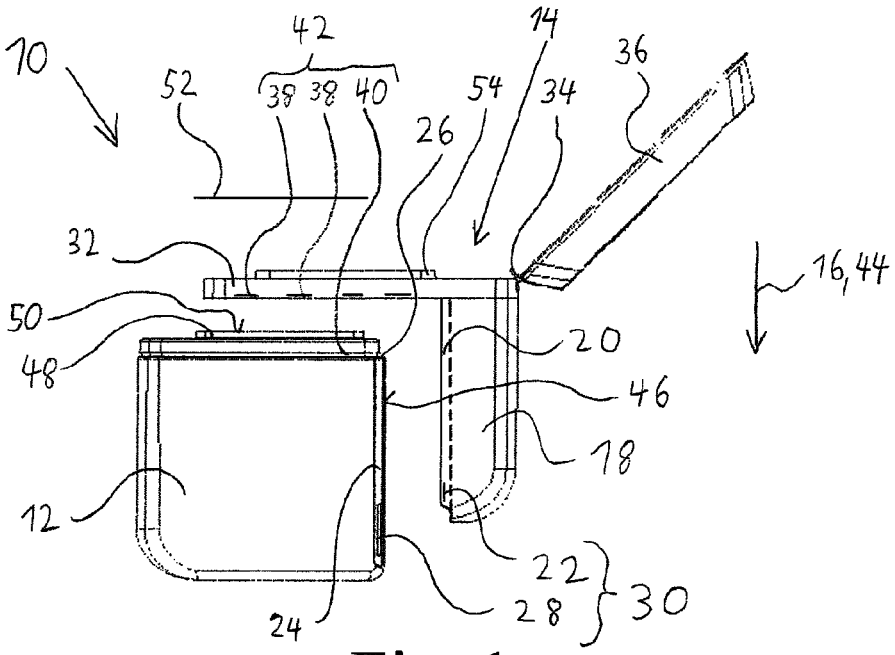

the fastening direction (44). Thereby, compartments (12, 14), are separated from each other, and provide a secure connection of the compartments (12, 14).

12 Claims, 1 Drawing Sheet

(51) Int. Cl.
*B65D 77/24* (2006.01)
*A47G 23/02* (2006.01)

(52) U.S. Cl.
CPC ..... *A47G 23/0258* (2013.01); *B65D 2519/00273* (2013.01); *B65D 2519/00333* (2013.01); *Y10T 29/49826* (2015.01)

(58) Field of Classification Search
USPC ..... 220/737, 62.12, 4.21, 4.26, 23.4, 521,220/735, 23.2; 222/192
See application file for complete search history.

(56) References Cited

U.S. PATENT DOCUMENTS

| | | | | |
|---|---|---|---|---|
| 5,540,343 | A * | 7/1996 | Schumacher | 215/235 |
| 6,123,214 | A | 9/2000 | Goebel | |
| 6,382,452 | B1 * | 5/2002 | Getachew et al. | 220/524 |
| 2001/0045432 | A1 * | 11/2001 | Jeoung Su | 220/23.4 |

FOREIGN PATENT DOCUMENTS

| | | | |
|---|---|---|---|
| WO | 2004/033329 | A | 4/2004 |
| WO | 2007/131806 | A1 | 11/2007 |

* cited by examiner

PACKAGING, USE OF A PACKAGING AND METHOD FOR ASSEMBLING SEVERAL PACKAGING

This application is a 371 application of PCT/EP2009/056850 filed Jun. 4, 2009, which claims foreign priority benefit under 35 U.S.C. §119 of EP application 08157657.1 filed Jun. 5, 2008.

The invention relates to a packaging by which a filling material can be received and securely transported. The invention further relates to the use of such a packaging as well as to a method for assembling several suchlike packaging.

U.S. Pat. No. 6,123,214 describes a packaging for receiving a filling material having two semi-cylindrical compartments for receiving the filling material, whereas the two compartments can be connected with each other. For the connection of one compartment with the other compartment, two guiding rails are provided in one of the compartments, wherein corresponding lugs of the other compartment can engage to that effect, that the other compartment can be inserted along an abutment plane, formed between the two compartments, in a top-down-pointing fastening direction. The compartment with the lugs additionally comprises at the upper end of its abutment face an arched lug encompassing the intermediate wall of the first compartment in the inserted state to that effect, that one compartment is fastened to the other compartment by means of the arched lug. Thus, by providing two compartments separated from each other in such a packaging, the packaging can be easily provided with different filling materials.

However, the disadvantage of such a packaging is that the filling material compartments if at all can only hardly be sealed. Therefore, suchlike packaging are not suitable to receive hygroscopic materials. Moreover, the filling material compartments of the packaging can easily detach from each other, in particular during transport, whereby the packaging can fall apart and the assignment of different filling materials to a defined packaging is affected.

The object of the invention is to provide a packaging for receiving a filling material, which allows to use compartments separated from each other and at the same time ensures a secure connection of the compartments, as well as the corresponding use of such a packaging and a corresponding method for assembling several suchlike packaging.

This object is solved according to the invention by a packaging, in particular a filling material packaging, having the technical features disclosed hereinafter, a use of the packaging, in particular of a filling material packaging, having the technical features set forth hereinafter and a method for assembling several packaging, in particular filling material packaging, having the technical features disclosed hereinafter. Advantageous embodiments of the invention are indicated hereinafter.

The packaging for receiving a filling material, in particular a hygroscopic powder, according to the invention comprises a filling material compartment for receiving the filling material. The packaging further comprises an additional compartment for forming an additional volume separated from the filling material compartment. The additional compartment can in particular receive a removal means for removing the filling material from the filling material compartment. The additional compartment is moveable along a fastening direction from an unfastened state to a fastened state fastened to the filling material compartment. In the fastened state, the additional compartment is fastened to the filling material compartment via a first fastening means.

Additionally, the additional compartment is fastened to the filling material compartment via a second fastening means, which is spaced to the first fastening means in fastening direction as well as crosswise to the fastening direction.

With the word "packaging" it is meant a device for receiving at least one product and/or a plurality of several products, which could be empty or at least partially filled with the intended product, whereby this device may comprise one or more different parts connected to each other and/or intended for being connected to each other. With the word "compaihnent" it is meant a physical unit for providing a volume for receiving at least one product and/or a plurality of several products. With the word "filling material" it is meant a product and/or a plurality of several products, which may be filled into a compartment of the packaging. With the word "fastening direction" it is meant a mainly linear direction of movement into which the one compartment have to be moved for fastening the one compartment with the second compartment. With the word "spaced crosswise to the fastening direction" it is meant, that the second fastening means is not positioned substantially in an abutment plane, where the filling material compartment is in contact to the additional compartment but offset to a projected plane spanned by the cross section of the abutment plane seen in fastening direction, wherein the cross section of the abutment plane is arranged completely within the projected plane.

The second fastening means is spaced to the abutment plane and in no direct functional relationship and in no direct contact with the abutment plane. This means that the second fastening means is not only an arched lug starting at the abutment plane for encompassing an intermediate wall of the first compartment. Instead the second fastening means may be significantly spaced to an intermediate wall between the additional compartment and the filling material compartment. Particularly the second fastening means is at least spaced to the closest part of the abutment plane by a distance s, wherein the ratio of the distance s to a contacting height h of the contacting plane in fastening direction is particularly $0.001<s/h$, preferably $0.01<s/h$, more preferred $0.10<s/h$ and most preferred $0.50<s/h$. Particularly the ratio s/h is particularly 5.00 s/h, preferably 1.00 s/h, more preferred 0.80 s/h and most preferred 0.50 s/h. Preferably for household applications it is preferred that the distance s is particularly 0.5 cm<s, preferably 1.0 cm<s, more preferred 2.5 cm<s and most preferred 5.0 cm<s. Particularly the distance s is particularly 20.0 cm s, preferably 10.0 cm s, more preferred 7.5 cm s and most preferred 5.0 cm s.

Since the packaging according to the invention comprises at least two separated compartments, which are different to each other, the packaging can easily be provided with different filling materials and/or the content of one compartment can individually be adapted to the content of the other compartment. The spaced arrangement of the second fastening means in particular to an abutment plane lying between the filling material compartment and the additional compartment, results in a fastening position for the second fastening means, whereas the fastening position of the second fastening means is spaced to the first fastening means in two different coordinate directions. The first fastening means and/or the second fastening means are particularly one-part with the additional compartment and/or the filling material compartment. Particularly no further separate connecting means besides the additional compartment and the filling material compartment is necessary for providing the required cohesion of the additional compartment to the filling material compartment. This provides a secure connection in an easy and cost efficient manner.

In particular, it is possible that the second fastening means is attached to the filling material compartment at position of the filling material compartment remotely placed to the position of the filling material compartment, wherein the first fastening means is fastened to the filling material compartment. Due to the in two coordinate directions spaced arrangement of the second fastening means relative to the first fastening means, a highly stable fastening of the additional compartment to the filling material compartment is achieved by simply implementable constructive means. A movement of the additional compartment relative to the filling material compartment caused by production tolerances can thereby be minimized An undesired detachment of the additional compartment from the filling material compartment and/or rattling of the packaging can thereby be avoided.

Preferably the first fastening means and the second fastening means lock two different detach directions, wherein the two different detach directions are particularly perpendicular to each other. For example the first fastening means locks a direction in mainly horizontal direction, wherein the second fastening means locks a direction in mainly vertical direction or vice versa. It is possible to lock a detaching in radial direction by the one fastening means and a detaching in axial direction by the other fastening means. Particularly a movement of the additional compartment relative to the filling material compartment up and down on the one hand as well as right and left on the other hand is locked by means of the first fastening means and the second fastening means. Due to the locking of two different detaching directions a secure connection of the additional container to the filling material container is given. At the same time an easy connection is possible since the second fastening means may come only at a time into function, when the intended end position of the additional compartment with respect to the filling material compartment is reached. Until the second fastening means comes into functions by fastening the additional compartment to the filling material compartment a movement along the intended locked detaching direction of the second fastening means may be still possible. This provides a secure connection in an easy and cost efficient manner.

In the unfastened state, for fastening the additional compartment to the filling material compartment, the additional compartment is in particular moveable in the fastening direction via a guide along an abutment plane of the filling material compartment. In particular, while moving the additional compartment from the unfastened to the fastened state, the additional compartment can slide on the abutment plane of the filling material compartment. In the fastened state, the additional compartment is fastened to the filling material compartment at least neighbouring to the guide via the first fastening means. The second fastening means is spaced to the abutment plane in fastening direction as well as crosswise to the fastening direction. By the guide, the additional compartment can quickly and easily be moved in a position, in which the additional compartment is securely fastened to the filling material compartment. By the first fastening means, the additional compartment can be fastened to the filling material compartment in the region of the guide so that the fastening by the first fastening means can automatically be achieved by moving the additional compartment relative to the filling material compartment. In particular, it is possible to avoid an unintended movement of the additional compartment relative to the filling material compartment crosswise to the fastening direction, whereas the spaced second fastening means can securely prevent a movement along the fastening direction.

Preferably, a non-detachable connection, for example a clip connection, is formed by the first fastening means and/or the second fastening means. By such a non-detachable connection, an unintended detachment of the additional compartment from the filling material compartment can securely be avoided. Furthermore, the arrangement of the second fastening means spaced in two coordinate directions to the first fastening means can ensure that production tolerances do not result in protruding of a latching lug of a clip connection from an undercut, both in case of the first fastening means and in case of the second fastening means. Even if in case of a clip connection the latching lug would stick out the latching groove due to production tolerances, the latching lug of the other clip connection would strongly push into the latching groove and prevent a movement of the protruding latching lug out of the latching groove region.

Within the scope of an especially preferred embodiment of the invention, the additional compartment comprises a lid frame by which an abutment face for a lid is formed. The lid frame comprises at least one part, in particular a latching lug, of the second fastening means. The lid frame can in particular surround a removal opening of the filling material compartment so that a plurality of second fastening means can be formed along the lid frame. In particular, if a top-down-pointing fastening direction, that means in gravitation direction, is provided by the guide, the lid frame can be arranged substantially perpendicular to the fastening direction and perpendicular to the abutment plane along which the additional compartment is moved across the filling material compartment. By this means, the second fastening means can be positioned widely spaced to the first fastening means by simple constructive design of the additional compartment. Furthermore, the lid frame can not only have the function to form the second fastening means, for example by forming several latching lugs by the lid frame. Additionally, the lid frame can form an abutment face for the lid enabling a tight fastening of the lid to the lid frame, which is in particular sealed enough that liquids, such as splash water, are securely lead off by the lid. The lid frame can in particular have a fastening element for the lid, which enables to detachably click the lid and the lid frame together.

The additional compartment in particular comprises a receiving compartment extending in the fastening direction, which can receive a removal means, in particular a spoon ladle, for removing a hygroscopic powder, for example a hair colorant. The receiving compartment comprises at least one part of the first fastening means so that the material for forming the receiving compartment can simultaneously form a part of the fastening means, for example a latching lug. This provides a secure connection in an easy and cost efficient manner. The receiving compartment in particular comprises a lug extending from the receiving compartment, whereas the part of the fastening means, which is formed by the receiving compartment, is arranged on the extending lug. By means of the lug, the implementation of the fastening means can be effected independently of the design of the receiving compartment. At the same time, the extending lug can very easily be guided of the guide, for example a guiding rail so that it is not necessary to form additional guiding elements by the additional compartment. Furthermore, this ensures that the first fastening means is positioned neighbouring to the guide, in particular within the guide so that a fastening is achievable in a region, which also should allow a movement of the additional compartment relative to the filling material compartment. This makes it easy to transfer the additional compartment from the unfastened and mobile state into the fastened and immobile state by simple constructive means.

Preferably, the filling material compartment comprises a guiding rail for guiding the additional compartment. The guiding rail comprises an inlet opening, in particular pointing against to the gravitation direction, for inserting a part of the first fastening means, in particular a latching lug. Simultaneously, the guiding rail forms spaced to the inlet opening a part of the first fastening means, in particular a latching groove. By this arrangement of the guiding rail, the latching lug can be inserted at the inlet opening into the guiding rail and guided during the further movement through the guiding rail until the latching lug automatically snaps into the latching groove, in particular arranged at the end of the guiding rail. The connection between the additional compartment and the filling material compartment can thereby be achieved in a fast, simple and intuitional manner. Simultaneously, by the latching lug engaging the latching groove a stable connection of the additional compartment and the filling material compartment can easily be achieved.

Within the scope of an especially preferred embodiment of the invention, the additional compartment is adapted substantially flush to the surface of the shape of the filling material compartment. The additional compartment and the filling material compartment thereby form an optical unit, which will be perceived as a joint packaging unit. Although two compartments separated from each other are provided in the packaging, the optical overall impression is thereby not affected. Additionally, thereby protruding edges and lugs can be avoided. This makes it possible to clean the surface of the filling material compartment and remarkably reduces the danger of ripping a packaging foil, by which the packaging can be wrapped.

Preferably, the additional compartment comprises a movable lid, in particular connected to the additional compartment via a film hinge. The lid can in particular be connected, for example clicked together, with the filling material compartment so that the connection of the additional compartment with the filling material compartment is additionally enhanced. This provides a secure connection of the additional compartment to the filling material compartment via the lid in an easy and cost efficient manner. Preferably, the lid covers in its closed state at least partially the filling material compartment as well as the additional compartment. By this means, one lid is sufficient to cover both the filling material compartment and the additional compartment and to protect them from environmental influences. Additionally, the handling of the packaging is simplified, since only one lid must be opened to remove the filling material from the filling material compartment by means of the thereby accessible removal means. In particular, if the filling material compartment contains chemically active substances, the user is automatically reminded of removing the substance by means of the removal means and not with the naked hand. Thereby, the appropriate handling with the filling material received by the filling material compartment is achieved and the risk of injury is reduced.

Within the scope of an especially preferred embodiment of the present invention, the filling material compartment comprises a removal opening, which is formed by an extending opening edge. The opening edge comprises a front face, which in particular points upwards against the gravitation direction. The front face is in particular arranged in a substantially common plane so that the removal opening can be sealed at the front face with a foil. Therefore, the foil can be glued and/or welded to the front face. This provides an additional connection of the additional compartment to the filling material compartment via the seal in an easy and cost efficient manner. In particular, by the means that the second fastening means is widely spaced from the first fastening means, there is enough space to form a sealable removal opening at the filling material compartment, which does not detrimentally influences the handling of the fastening means. The handling of the fastening means can even be enhanced by a removal opening, which for example comprises latching grooves for latching lugs for forming the second fastening means. Simultaneously, this ensures that a damage of the sealing, in particular by perforating the foil, is avoided while connecting the additional compartment to the filling material compartment. The filling material compartment can therefore preferably receive hydrophilic materials and/or hygroscopic materials, for example bleaching powder.

The packaging can in particular have a retaining strap, which exerts a retaining force on the filling material compartment as well as on the additional compartment. The retaining strap can for example be an adhesive label, which is glued to both the additional compartment and the filling material compartment. Furthermore, the retaining strap can be a circumferential sleeve, which is in particular at least slightly expandable, and exerts a retaining force from outside in radial direction on the additional compartment and the filling material compartment. The connection between the additional compartment and the filling material compartment is thereby additionally enhanced. This provides an additional secure connection of the additional compartment to the filling material compartment via the retaining strap in an easy and cost efficient manner. In particular, the retaining strap can be provided with information on the content of the packaging. Thereby, it is for example possible to provide warning notices concerning the filling material without therefore colouring and/or embossing the additional compartment and/or the filling material compartment. The packaging is therefore easy to manufacture and to assemble.

The invention further relates to the use of a packaging, which can be designed and formed as described above. Thereby, an in particular powdery, in particular hygroscopic, hair colorant is received by the filling material compartment. The hair colorant is for example a bleaching agent, whose effect might be detrimentally affected by contact with air humidity. Since the filling material compartment of the packaging can easily be sealed, the packaging is especially suitable for receiving a hair colorant. In particular, it is possible to provide several different packaging for different hair colour shades, whereas each of the different packaging is provided with a different hair colorant, but whereas each of the different packaging comprises a similar additional compartment. The use of the packaging for receiving a hair colorant therefore allows assembling different hair colorant shades in an especially simple manner, while averting the danger that the packaging falls unintentionally apart. At the same time during the application of the hair colorant a secure connection of the additional compartment to the filling material compartment in an easy and cost efficient manner is provided.

The invention further relates to a method for assembling several packaging, which can be designed and formed as described above. At least one first sealed filling material compartment is provided, which contains a first filling material, in particular a hair colorant for a first colour. Furthermore, at least one second sealed filling material compartment is provided, which contains a second filling material different to the first filling material. The second filling material is for example a hair colorant for a colour different to the colour of the first hair colorant. The second filling material compartment is formed substantially identically to the first filling material compartment. Moreover, several essentially identically formed additional compartments are provided. Corresponding to a purchase requisition concerning different filling materials, at least one first filling material compartment and at least one second filling material compartment is selected. The selected first filling material compartment is connected with the additional compartment. The selected second filling material compartment is connected with another but identically formed additional compartment. Such a connection results in a packaging, which can be designed and formed as described above. By such an assembling method, it is possible to keep ready a plurality of filling material compartments with hair colorants for different colour shades and to connect these compartments with identically formed additional compartments during assembling for a particular order. The required storage space can thereby significantly be reduced. In particular, it is not necessary to build stocks of additional compartments appendent on each different hair colour shade. In lieu thereof, it is sufficient to built stocks of only one kind of additional compartment and to connect each individually prepared filling material compartment with such an additional compartment. Although the connection of the additional compartment to the filling material compartment takes place comparatively late in the production chain, a secure connection of the additional compartment to the filling material compartment in an easy and cost efficient manner is provided.

Within the scope of a preferred embodiment of this method, the additional compartment is provided with a removal means, in particular a spoon ladle, suitable for the respective filling material and/or with an information carrier, in particular an instruction, concerning the respective filling material, corresponding to a purchase requisition concerning different filling materials. Thereby, it is possible to individually adapt the additional compartment to a filling material compartment containing a particular filling material, without complicating the storage of the additional compartment. For example, it is possible to store an instruction for a hair colorant concerning a particular colour shade, separated to the additional compartment and to provide an arbitrary stored additional compartment with the respective instruction after receiving a purchase requisition. This allows a high individuality of the packaging and an extremely large array of filling materials, without complicating the storage. Assembling several packaging is thereby significantly facilitated.

Figure 2:
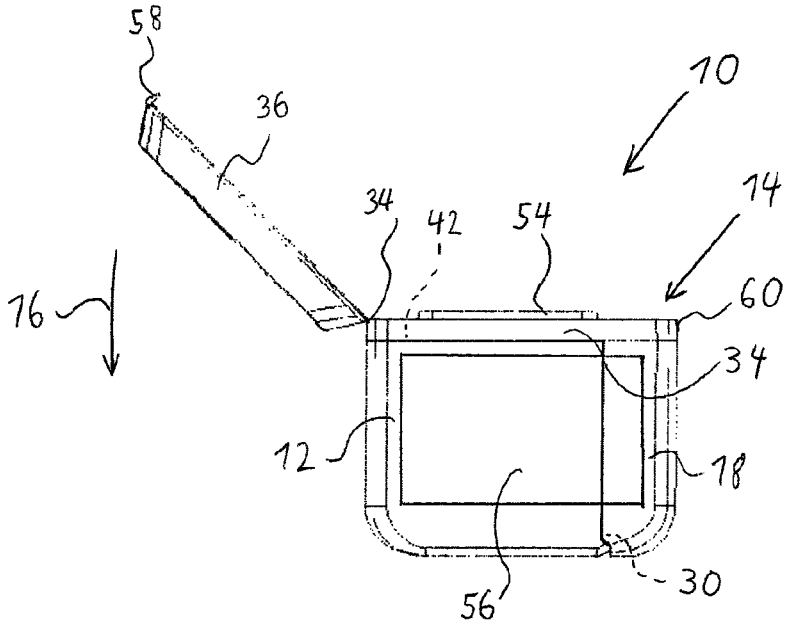

In the following, the invention is explained in detail with reference to the enclosed drawings showing a preferred embodiment of the present invention:

FIG. 1 shows a schematic exploded front view of a packaging according to the invention; and FIG. 2 shows a schematic exploded rear view of the packaging of FIG. 1.

The packaging 10, shown in FIG. 1, comprises a filling material compartment 12 and a significantly smaller additional compartment 14. The filling material compartment 12 can be manufactured from polyethylene by blow moulding. The additional compartment 14 can in particular be manufactured from polypropylene by plastic injection moulding. The additional compartment 14 comprises a receiving compartment 18 extending in gravitation direction. In this receiving compartment 18 for example a removal spoon for removing filling material from the filling material compartment 12 can be placed in order to avoid that the user must dig the removal spoon out of the filling material in the filling material compartment 12. A lug 20 extends from the receiving compartment 18. This lug 20 comprises in its downer part a latching lug 22. The lug 20 can be guided in a guiding rail 24 of the filling material compartment 12. For this, the latching lug 22 can be inserted into an up-pointing inlet opening 26 of the guiding rail 24 and moved downwards in gravitation direction until the latching lug 22 snaps into a latching groove 28. By snapping the latching lug 22 into the latching groove 28 a first fastening means 30 is formed.

The additional compartment 14 further comprises a lid frame 32 arranged perpendicular to the gravitation direction 16. With this lid frame 32 a lid 36 is connected via a film hinge 34. In the closed state, the lid 36 covers the receiving compartment 18 as well as the filling material compartment 12. The lid frame 32 comprises several latching lugs 38. By movement of the additional compartment 14 in gravitation direction, these latching lugs 38 can snap into a latching groove 40 of the filling material compartment 12. By the latching lugs 38 and the latching groove 40, a second fastening means 42 is formed. The second fastening means 42 is spaced to a downwards pointing fastening direction 44 as well as to a crosswise to the fastening direction 44 arranged along an abutment plane 46 of the filling material compartment 12, on which the receiving compartment 18 of the additional compartment 14 is moved along during the fastening.

The filling material compartment 12 comprises an opening edge 48, by which the removal opening for the filling material of the filling material compartment 12 is formed. The opening edge 48 comprises a front face 50 facing against the gravitation direction 16, which is arranged along the whole opening edge 48 in one common plane. A sealing foil 52 can be glued or welded to the front face 50 of the opening edge 48 so that even hygroscopic materials can be received by the filling material compartment 12. The additional compartment 14 further comprises an additional edge 54, which is formed in a position slightly higher than the opening edge 48 to reduce the danger of damaging the sealing foil 52.

In the fastened state (FIG. 2) of the packaging 10, the outer shape of the additional compartment 12, in particular in the region of the receiving compartment 18, fits with the outer shape of the filling material compartment 12. The additional compartment 14 is in this case in particular flush with the surface of the filling material compartment 12 so that lugs and ledges are avoided. In the illustrated embodiment, the packaging 10 comprises an adhesive label 56, which glues to the filling material compartment 12 as well as to the additional compartment 14 in the region of the receiving compartment 18. Furthermore, the lid 36 comprises a latching lug 58, which can snap into a latching receiver 60 of the additional compartment 14.

The invention claimed is:

1. A packaging for receiving a filling material, the packaging comprising a filling material compartment, for receiving the filling material, having a total length defined between a first side and a second side of the filling material compartment and a total height defined between a top side and a bottom side of the filling material compartment, wherein the top side comprises a latching groove that extends across a majority of the total length of the filling material compartment, the first side extends from the top side to the bottom side of the filling material compartment and comprises a guiding rail that extends across a majority of the total height of the filling material compartment, the guiding rail comprises a up-pointing inlet opening adjacent to the top side of the filling material compartment and a latching groove is provided on the first side of the filling material compartment adjacent to the bottom side of the filling material compartment, and an additional compartment for forming an additional volume separated from the filling material compartment, wherein the additional compartment comprises first and second portions extending in different directions, wherein the additional compartment is moveable along a first fastening direction for fastening the additional compartment to the filling material compartment, wherein the additional compartment is fastened to the filling material compartment via a first fastening means and a second fastening means spaced to the first fastening means both in the first fastening direction and a second fastening direction that is crosswise with respect to the first fastening direction, wherein the first fastening means and the second fastening means lock two different detach directions comprising the first and second fastening directions, and further wherein, when the additional compartment is fastened to the filling material compartment, the first portion of the additional compartment covers the top side of the filling material compartment and the latching groove and the second portion of the additional compartment covers the first side of the filling material compartment and the guiding rail.

2. The packaging according to claim 1, wherein the additional compartment is moveable in the first fastening direction via the guiding rail along an abutment plane of the filling material compartment for fastening the additional compartment to the filling material compartment, wherein the additional compartment is fastened to the filling material compartment at least neighbouring to the guiding rail via the first fastening means and the second fastening means is spaced to the abutment plane both in first fastening direction and the second fastening direction crosswise with respect to the first fastening direction.

3. The packaging according to claim 1, wherein a clip connection is formed by at least one of the first fastening means and the second fastening means.

4. The packaging according to claim 1, wherein the additional compartment comprises a lid frame for forming an abutment face for a lid, wherein the lid frame comprises at least a first part of the second fastening means.

5. The packaging according to claim 1, wherein the additional compartment comprises a lid frame and a receiving compartment for receiving a removal means, whereas the receiving compartment comprises at least a first part of the first fastening means.

6. The packaging according to claim 1, wherein the guiding rail is adapted for guiding the additional compartment, wherein a first part of the first fastening means is inserted into the up-pointing inlet opening of guiding rail, and further wherein the guiding rail forms a second part of the first fastening means.

7. The packaging according to claim 1, wherein the additional compartment is adapted substantially surface-flush to the shape of the filling material compartment.

8. The packaging according to claim 1, wherein the additional compartment comprises a lid, moveable via a film hinge, wherein the lid covers, in a closed state, at least partially both the filling material compartment and the additional compartment.

9. The packaging according to claim 1, wherein the filling material compartment comprises a removal opening formed by an extending opening edge, wherein the opening edge comprises a front face substantially lying in a common plane for sealing the removal opening with a foil.

10. The packaging according to claim 1, wherein a retaining strap, comprising at least one of an adhesive label and a circumferential sleeve, exerts a retaining force on both the filling material compartment and the additional compartment.

11. The packaging according to claim 1, wherein the additional compartment comprises a removal means for removing the filling material from the filling material compartment, and the filling material present within the filling material compartment comprises hygroscopic materials.

12. The packaging according to claim 1, wherein the first and second portions of the additional compartment extend perpendicular with respect to each other.

* * * * *